United States Patent [19]

Yaguinuma

[11] 4,027,469

[45] June 7, 1977

[54] DATING MECHANISM FOR CALENDAR CLOCKS

[75] Inventor: Jusuke Yaguinuma, Koriyami, Japan

[73] Assignee: Copal Company Limited, Tokyo, Japan

[22] Filed: Sept. 30, 1975

[21] Appl. No.: 618,240

[30] Foreign Application Priority Data

Sept. 30, 1974 Japan ..... 49-118084

[52] U.S. Cl. ..... 58/6 R; 58/125 C

[51] Int. Cl.[2] ..... G04B 19/24; G04B 19/02

[58] Field of Search ..... 58/4 R, 6 R, 125 C, 58/127 R, 1

[56] References Cited

UNITED STATES PATENTS

| | | | |
|---|---|---|---|
| 2,712,725 | 7/1955 | Bell | 58/6 A |
| 2,790,300 | 4/1957 | Lux | 58/6 A |

FOREIGN PATENTS OR APPLICATIONS

| | | | |
|---|---|---|---|
| 1,172,123 | 11/1969 | United Kingdom | 58/6 R |

*Primary Examiner*—E. S. Jackmon

*Attorney, Agent, or Firm*—Cushman, Darby & Cushman

[57] ABSTRACT

A dating mechanism for calendar clocks wherein, in order to simplify a motion transmitting mechanism for intermittently rotating a date indicating drum or a week day indicating drum by the rotation of an hour indicating drum, the hour and minute indicating drums arranged adjacently on the same axis and the date and week day indicating drums arranged adjacently on the other same axis are arranged parallelly above and below and an intermittently feeding lever for transmitting the rotation of the hour indicating drum to the date indicating drum is provided between the hour indicating drum and date indicating drum.

6 Claims, 4 Drawing Figures

DATING MECHANISM FOR CALENDAR CLOCKS

BACKGROUND OF THE INVENTION a. Field of the Invention:

The present invention relates to dating mechanisms for calendar clocks and more particularly to date and week day indicating mechanisms for digital calendar clocks.

b. Description of the Prior Art:

In a known conventional digital calendar clock, it is general that respective date, week day, hour and minute indicating drums are arranged on the same axis. However, in the case of such arrangement, there have been defects that a speed reduction mechanism for transmitting a motion from the hour indicating drum to the date or week day indicating drum is likely to become complicated and that therefore the efficiency of the assembling operation is low.

SUMMARY OF THE INVENTION

A primary object of the present invention is to provide a dating mechanism for calendar clocks wherein hour and minute indicating drums arranged adjacently on the same axis and date and week day indicating drums arranged adjacently on the outer same axis are arranged parallely above and below so that such defects as are mentioned above may be eliminated.

Another object of the present invention is to provide a digital calendar clock formed to be very compact as a whole and positive in the operation.

A further object of the present invention is to provide a dating mechanism for calendar clocks which is simple in the assembling operation.

These and other objects of the present invention will become more apparent during the course of the following detailed description and appended claims.

DESCRIPTION OF THE PREFERRED EMBODIMENTS

Figure 1:
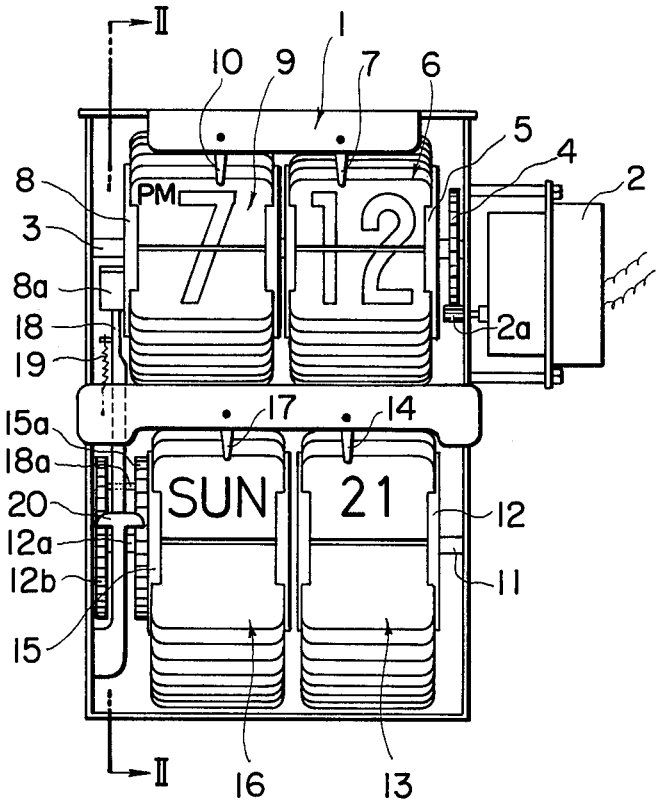
FIG. 1 is an elevation of an essential part of an embodiment of a digital calendar clock according to the present invention.
Figure 2:
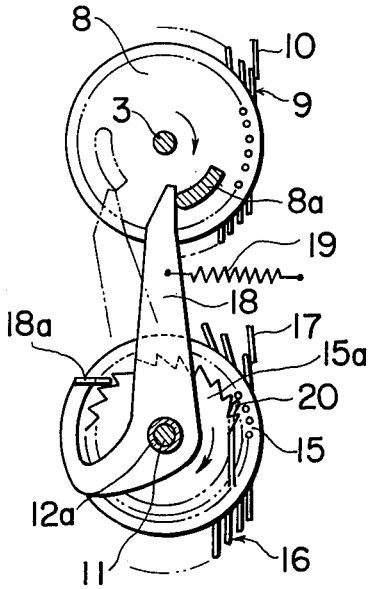
FIG. 2 is a sectioned view on line II—II in FIG. 1 shown by removing a body frame.

Referring to FIGS. 1 and 2, numeral 1 signifies a body frame, numeral 2 signifies a driving motor fitted to the body frame 1 and having a pinion 2*a* at the tip of an output shaft, numeral 3 signifies a rotary shaft rotatably borne on the body frame 1, numeral 4 signifies a gear secured to the rotary shaft 3 and meshed with the pinion 2*a*, numeral 5 signifies a minute indicating drum secured to the rotary shaft 3, numeral 6 signifies one of many minute indicating leaves pivotably supported on the minute indicating drum, numeral 7 signifies a holding piece secured to the body frame 1 and for holding the minute indicating leaves 6 in a vertical position, numeral 8 signifies an hour indicating drum mounted rotatably on the rotary shaft 3 and having a projection 8*a* on one side surface, numeral 9 signifies one of many hour indicating leaves pivotably supported on the hour indicating drum 8 and numeral 10 signifies a holding piece secured to the body frame 1 and for holding the hour indicating leaves 9 in a vertical position. The hour indicating drum 8 is connected with the minute indicating drum 5, that is, the rotary shaft 3 through a well known speed reduction gear so as to make one or two rotations during 24 hours and to be able to indicate the time through the leaves 6 and 9 together with the minute indicating drum 5.

Numeral 11 signifies a supporting shaft fitted to the body frame 1 parallelly with the rotary shaft 3. Numeral 12 signifies a date indicating drum mounted rotatably on the supporting shaft 11 and having a ratchet wheel 12*b* in a position adjacent to one side wall of the body frame 1 through a tubular shaft 12*a* rotatably fitted to the supporting shaft 11. Numeral 13 signifies one of many date indicating leaves pivotably supported on the date indicating drum 12. Numeral 14 signifies a holding piece secured to the body frame 1 and for holding the date indicating leaves 13 in a vertical position. Numeral 15 signifies a week day indicating drum mounted rotatably on the tubular shaft 12*a* and having a ratchet wheel 15*a* opposed to the above mentioned ratchet wheel 12*b* on one side surface. Numeral 16 signifies one of many week day indicating leaves pivotably supported on the week day indicating drum 15. Numeral 17 signifies a holding piece secured to the body frame 1 and for holding the week day indicating leaves 16 in a vertical position.

Numeral 18 signifies a feeding lever supported rotatably on the tubular shaft 12*a*, extending at one arm end to a position in which it can engage with the projection 8*a* of the hour indicating drum 8 and forming at the other arm end a ratchet 18*a* which can engage with the ratchet wheel 12*b* of the date indicating drum 12 and the ratchet wheel 15*a* of the week day indicating drum 15. Numeral 19 signifies a spring clockwise biasing the feeding lever 18 in the position in FIG. 2. Numeral 20 signifies a plate spring secured in the base portion to the body frame 1 and engaged in the tip portion with the ratchet wheels 12*b* and 15*a* to prevent the reverse rotation of the date indicating drum 12 and week day indicating drum 15 and to regulate their rotating positions.

The operation of this mechanism shall be explained in the following by exemplifying the case of rotating the week day indicating drum 15 with the rotation of the hour indicating drum 8 by particularly referring to FIG. 2.

When the driving motor 2 rotates, the hour indicating drum 8 will be rotated in the direction indicated by the arrow in FIG. 2. But, at a predetermined time, the projection 8*a* will contact the feeding lever 18 and will push it to counterclockwise rotate the feeding lever 18 against the spring 19. With this counterclockwise rotation of the feeding lever 18, the ratchet 18*a* will move in the counterclockwise direction around the tubular shaft 12*a* and will engage with the bottom of a tooth preceding by one tooth in the counterclockwise direction in FIG. 2 by overpassing the tooth tip of the ratchet wheel 15*a* while flexing due to its own resiliency. In this case, due to the frictional force between the ratchet 18*a* and ratchet wheel 15*a*, the ratchet wheel 15*a* will tend to be rotated counterclockwise in FIG. 2. But this tendency will be prevented by the plate spring 20. Thus, when the time indicated by the indicating leaves 9 and 6 approaches 12:00 P.M. (0:00 A.M.), the projection 8*a* of the hour indicating drum 8 will move to the chain line position in FIG. 2 but, the moment when the indicated time becomes 12:00 P.M., the feeding lever 18 will disengage from the projection 8*a* and will be quickly rotated clockwise in FIG. 2 by the spring 19. By this clockwise rotation of the feeding lever 18, the ratchet wheel 15*a*, that is, the week day indicating drum 15 will be rotated clockwise by one tooth of the ratchet wheel 15*a* and the next week day will be indicated through the week day indicating leaf 16. Thereafter, while repeating such operation as is mentioned above at intervals of 24 hours or of 12 hours (in case two leaves indicating the same week day are provided), new week days will be indicated in turn.

The case that the week day indicating drum 15 is rotated by the rotation of the hour indicating drum 8 has been explained in the above. The ratchet 18*a* of the feeding lever 18 will act the same also on the ratchet 12*b* of the date indicating drum 12 to rotate the date indicating drum 12 intermittently in turn to indicate dates. However, in such case, as the ratchet wheels 15*a* and 12*b* are different from each other in the number of teeth (for example, it is usual that the ratchet wheel 15*a* has $7 \times 4 = 28$ teeth and the ratchet wheel 12*b* has 31 teeth), in case, for example, the ratchet wheels 15*a* and 12*b* are made to be of the same diameter, the ratchet wheel 15*a* will become larger than the ratchet wheet 12*b*, in the pitch of the teeth. Therefore, as a result, the ratchet 18*a* of the feeding lever 18 will overpass the tooth tip of the ratchet wheel 12*b*, will then slightly move, will overpass the tooth tip of the ratchet wheel 15*a* and will engage with the tooth bottoms of both ratchet wheels 12*b* and 15*a*. When the projection 8*a* of the hour indicating drum 8 disengages from the feeding lever 18, the ratchet 18*a* will first push the ratchet wheel 15*a* and will then push the ratchet wheel 12*b* to rotate both ratchet wheels 12*b* and 15*a*.

Figure 3:
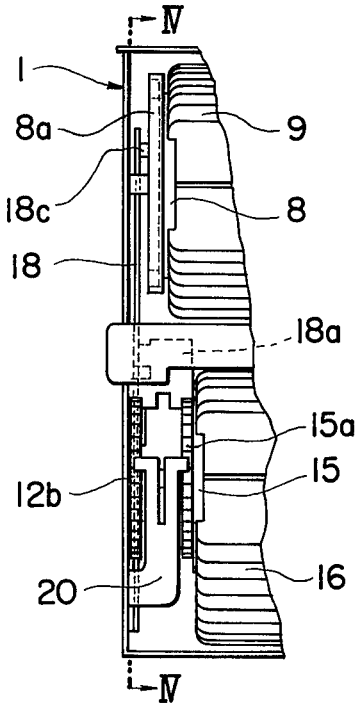
FIG. 3 is a partial elevation showing an essential part of another embodiment of a digital calendar clock according to the present invention.
Figure 4:
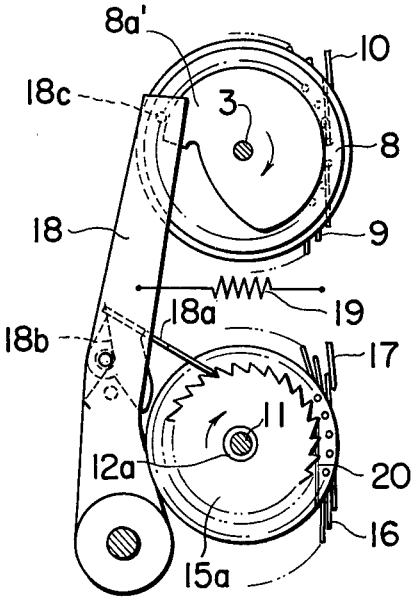
FIG. 4 is the same sectioned view as FIG. 2 on line IV—IV in FIG. 3.

In the above explained embodiment, the operating member provided in the hour indicating drum 8 is formed as an arcuate projection 8*a* and the feeding lever 18 is rotatably supported on the tubular shaft 12*a* but these can be altered as shown in FIGS. 3 and 4.

That is to say, in the embodiment shown in FIGS. 3 and 4, the operating member 8*a* provided on the hour indicating drum 8 is formed as a cam projecting on the side surface of the drum 8, the feeding lever 18 is rotatably supported on the body frame 1 and the ratchet 18*a* is formed as another member rotatably fitted on the feeding lever 18. The ratchet member 18*a* is biased counterclockwise in the position in FIG. 4 by a spring 18*b* and the feeding lever 18 is pressed against the peripheral side surface of the cam 8*a* by the spring 19 through a pin 18*c*.

By the way, the operation of this embodiment is the same as is explained with reference to FIGS. 1 and 2 and therefore shall not be explained in detail.

In the above explained embodiment, at least the ratchet portion 18*a* of the feeding lever 18 is formed preferably of a spring material and the date indicating drum 12 and week day indicating drum 15 may be arranged as interchanged with each other in the position.

I claim:

1. A dating mechanism for leaf-type calendar clocks comprising a body frame, a minute indicating drum and hour indicating drum respectively rotatably adjacently arranged on a first axis mounted on said body frame, a date indicating drum and week day indicating drum respectively rotatably adjacently arranged on a second axis parallel with said first axis, said minute and hour indicating drums being arranged parallelly above said date and week day indicating drums, a first ratchet wheel provided concentrically and integrally with said date indicating drum on one side surface of said date indicating drum, a second ratchet wheel provided concentrically and integrally with said week day indicating drum on one side surface of said week day indicating drum and opposed to said first ratchet wheel, an operating member provided integrally with said hour indicating drum on one side surface of said hour indicating drum, and a feeding lever engageable with said operating member and having a ratchet portion thereon engaging with said first and second ratchet wheels, said date indicating drum and week day indicating drum being intermittently rotated by a predetermined angle through said feeding lever at intervals of one rotation of said hour indicating drum.

2. A dating mechanism for calendar clocks according to claim 1 wherein said operating member is a projection.

3. A dating mechanism for calendar clocks according to claim 1 wherein said operating member is a cam.

4. A dating mechanism for calendar clocks according to claim 1 wherein said ratchet portion is made of a spring material and is formed integrally with said feeding lever.

5. A dating mechanism for calendar clocks according to claim 1 wherein said ratchet portion is made of a spring material and is rotatably supported on said feeding lever.

6. A dating mechanism for calendar clocks according to claim 1 wherein said dating mechanism further comprises a plate spring secured in the base portion of said body frame and having thereon a first tip portion engaging with said first ratchet wheel and a second tip portion separated from said first tip portion engaging with said second ratchet wheel to prevent the reverse rotation of said date indicating drum and week day indicating drum.

* * * * *